US010672345B2

(12) United States Patent
Xiang et al.

(10) Patent No.: US 10,672,345 B2
(45) Date of Patent: Jun. 2, 2020

(54) ORGANIC LIGHT EMITTING DISPLAY PANEL, DRIVING METHOD THEREOF AND ORGANIC LIGHT EMITTING DISPLAY APPARATUS

(71) Applicant: SHANGHAI TIANMA AM-OLED CO., LTD., Shanghai (CN)

(72) Inventors: Dongxu Xiang, Shanghai (CN); Yue Li, Shanghai (CN); Renyuan Zhu, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 224 days.

(21) Appl. No.: 15/593,734

(22) Filed: May 12, 2017

(65) Prior Publication Data

US 2017/0249900 A1 Aug. 31, 2017

(30) Foreign Application Priority Data

Jan. 5, 2017 (CN) ..... 2017 1 0007312

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0426* (2013.01);
(Continued)

(58) Field of Classification Search
None
See application file for complete search history.

(56) References Cited

U.S. PATENT DOCUMENTS

2015/0002558 A1 1/2015 Kumeta et al.
2016/0210898 A1 7/2016 Tsuge et al.
(Continued)

FOREIGN PATENT DOCUMENTS

CN 102930821 A 2/2013
CN 104464643 A 3/2015

OTHER PUBLICATIONS

CN Application No. 201710007312.9, 1st Office Action dated Jul. 30, 2018.

*Primary Examiner* — Andre L Matthews
(74) *Attorney, Agent, or Firm* — Alston & Bird LLP

(57) ABSTRACT

The present disclosure discloses an organic light emitting display panel, a driving method thereof, and an organic light emitting display apparatus. The organic light emitting display panel includes a plurality of pixel driving circuits, the pixel driving circuit comprising: a driving module including a driving transistor and a first capacitor; an initialization module for writing signals of a first initialization signal terminal and a second initialization signal terminal respectively to a gate and a first electrode of the driving transistor; a data writing module; a light emitting control module including a first transistor, a gate, a first electrode and a second electrode of the first transistor respectively connecting to a light emitting signal terminal, a second electrode plate of the first capacitor and the gate of the driving transistor; an organic light emitting diode, a cathode of the organic light emitting diode connecting to a second voltage terminal.

10 Claims, 8 Drawing Sheets

(52) U.S. Cl.
CPC ..... *G09G 2300/0814* (2013.01); *G09G 2300/0819* (2013.01); *G09G 2300/0842* (2013.01); *G09G 2300/0861* (2013.01); *G09G 2310/0245* (2013.01); *G09G 2310/0251* (2013.01); *G09G 2310/0262* (2013.01); *G09G 2320/0233* (2013.01)

(56) References Cited

U.S. PATENT DOCUMENTS

2016/0293103 A1* 10/2016 Kimura ..... G09G 3/3233
2017/0110056 A1* 4/2017 Hu ..... G09G 3/3258

* cited by examiner

900

ORGANIC LIGHT EMITTING DISPLAY PANEL, DRIVING METHOD THEREOF AND ORGANIC LIGHT EMITTING DISPLAY APPARATUS

CROSS REFERENCE TO RELATED APPLICATION

This disclosure claims the benefit of Chinese Patent Application No. CN201710007312.9, filed on Jan. 5, 2017, entitled "Organic Light Emitting Display Panel, Driving Method thereof and Organic Light Emitting Display Apparatus," the disclosure of which is incorporated herein by reference in its entirety.

TECHNICAL FIELD

The present disclosure relates to the field of display technology, and specifically relates to an organic light emitting display panel and a driving method thereof, and an organic light emitting display apparatus.

BACKGROUND

Utilizing the self-luminous property of organic semiconductor material for displaying, an organic light emitting display (OLED) has the advantages of, among others, high contrast and low power consumption. Typically, the display area of the organic light emitting display is provided with a pixel array composed of pixels and sub-pixels. Each sub-pixel contains an organic light emitting diode, driven by a pixel driving circuit to emit light.

A conventional pixel driving circuit may include a driving transistor which provides a light emitting current to an organic light emitting device under the control of a light emitting control signal. Since the light emitting current of the organic light emitting diode is related to a threshold voltage Vth of the driving transistor, the shifting of the threshold voltage Vth of the driving transistor (i.e., "threshold shift") due to manufacture, aging after extended use, and other causes will result in the luminance of the organic light emitting device being unstable. In addition, in the conventional pixel driving circuit, the light emitting current of the organic light emitting diode is affected by a capacitance value thereof. Since capacitance values of organic light emitting diodes in different pixel driving circuits may not be the same, even if an identical data signal is provided, the luminances of various organic light emitting diodes will be different, resulting in reduced uniformity for the display luminance. Therefore, a solution for uniform display is needed.

SUMMARY

The present disclosure provides an organic light emitting display panel and a driving method thereof, and an organic light emitting display apparatus to solve the technical problems mentioned in background section.

In a first aspect, the present disclosure provides an organic light emitting display panel including a plurality of pixel driving circuits arranged in a matrix of a plurality of rows and a plurality of columns, where the pixel driving circuit comprises a first scanning signal terminal, a second scanning signal terminal, a light emitting signal terminal, a data signal terminal, a first initialization signal terminal, a second initialization signal, a first voltage terminal, a second voltage terminal, a driving module, an initialization module, a data writing module, a light emitting control module and an organic light emitting diode. The driving module includes a driving transistor and a first capacitor, wherein the first capacitor includes a first electrode plate and a second electrode plate, wherein the first electrode plate electrically connects to a first electrode of the driving transistor, wherein a second electrode of the driving transistor electrically connects to the first voltage terminal, and wherein the driving transistor provides a light emitting current to an anode of the organic light emitting diode under the control of the light emitting control module. The initialization module electrically connects to a gate of the driving transistor and the first electrode of the driving transistor, for writing signals from the first initialization signal terminal and the second initialization signal terminal respectively to both the gate of the driving transistor and the first electrode of the driving transistor, under the control of the first scanning signal terminal and the second scanning signal terminal. The data writing module electrically connects to the second electrode plate of the first capacitor, for transmitting a signal of the data signal terminal to the second electrode plate of the first capacitor, under the control of the first scanning signal terminal. The light emitting control module comprises a first transistor, wherein a gate of the first transistor electrically connects to the light emitting signal terminal, a first electrode of the first transistor electrically connects to the second electrode plate of the first capacitor, and a second electrode of the first transistor electrically connects to the gate of the driving transistor. A cathode of the organic light emitting diode electrically connects to the second voltage terminal.

In a second aspect, the present disclosure provides a driving method applied to the organic light emitting display panel, comprising: in a first phase, providing a first level signal to the first scanning signal terminal and the second scanning signal terminal; providing a second level signal to the light emitting signal terminal; providing a first initialization signal to the first initialization signal terminal; providing a second initialization signal to the second initialization signal terminal; providing a data signal to the data signal terminal; writing by the initialization module the first initialization signal and the second initialization signal respectively into the gate and the first electrode of the driving transistor, transmitting the data signal to the second electrode plate of the first capacitor by the data writing module; in a second phase, providing the first level signal to the first scanning signal terminal; providing the second level signal to the second scanning signal terminal and the light emitting signal terminal; providing the first initialization signal to the first initialization signal terminal; providing the data signal to the data signal terminal; writing the first initialization signal into the gate of the driving transistor by the initialization module, transmitting the data signal to the second electrode plate of the first capacitor by the data writing module; turning on the driving transistor; charging the first electrode plate of the first capacitor by the first voltage terminal; in a third phase, providing the second level signal to the first scanning signal terminal and the second scanning signal terminal; providing the first level signal to the light emitting signal terminal; turning on the driving transistor and the first transistor; charging the first electrode of the driving transistor by the first voltage terminal; turning on the second electrode plate of the first capacitor and the gate of the driving transistor by the light emitting control module, wherein a potential of the gate of the driving transistor rises under the coupling of the first capacitor; and light emitting from the organic light emitting diode under a voltage difference between the gate and the first electrode of the driving transistor, the organic light emitting from the organic light emitting diode under a voltage difference between the gate and the first electrode of the driving transistor; wherein a voltage value of the first initialization signal is greater than a sum of a voltage value of the second initialization signal and a threshold voltage of the driving transistor; a voltage difference between the second initialization signal and the second voltage terminal is less than a break-over voltage of the organic light emitting diode.

In a third aspect, the present disclosure provides an organic light emitting display apparatus, including the organic light emitting display panel.

The organic light emitting display panel and the driving method thereof, and the organic light emitting display apparatus provided by the present disclosure may compensate the threshold voltage of the driving transistor while the potential of the node of the first capacitor connected to the first electrode of the driving transistor would not be changed by the coupling of the first capacitor, and the first capacitor does not cause the organic light emitting diode to divide the potential of the node of the first capacitor connected to the first electrode of the driving transistor to ensure that the potentials of the gate and the first electrode of the driving transistor are independent of the light emitting current and the capacitance values thereof of the organic light emitting diode, and the display luminance of each organic light emitting diode does not change abnormally due to the impact of its capacitance value, thereby improving the uniformity of the display luminance of the display panel and improving the display effect.

BRIEF DESCRIPTION OF THE DRAWINGS

Other features, objectives and advantages of the present disclosure will become more apparent upon reading the detailed description to non-limiting embodiments with reference to the accompanying drawings, wherein.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
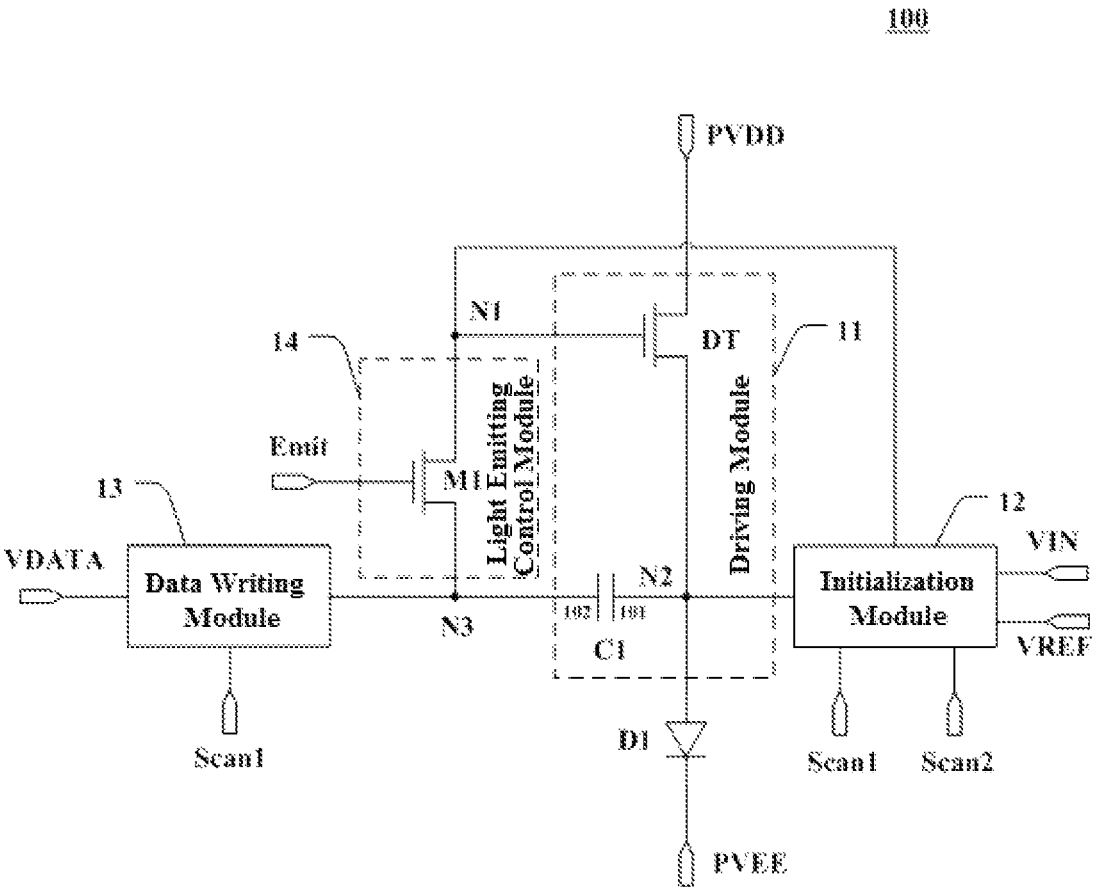
FIG. 1 is a schematic structural diagram of an embodiment of a pixel driving circuit in an organic light emitting display panel according to the present disclosure.

Referring to FIG. 1, a schematic structural diagram of an embodiment of a pixel driving circuit in an organic light emitting display panel according to the present disclosure is illustrated. In the present embodiment, the organic light emitting display panel includes a plurality of pixel driving circuits 100 arranged in a matrix.

As shown in FIG. 1, the pixel driving circuit 100 includes a first scanning signal terminal Scan1, a second scanning signal terminal Scan2, a light emitting signal terminal Emit, a data signal terminal VDATA, a first initialization signal terminal VIN, a second initialization signal terminal VREF, a first voltage terminal PVDD, a second voltage terminal PVEE, a driving module 11, an initialization module 12, a data writing module 13, a light emitting control module 14 and an organic light emitting diode D1.

The driving module 11 includes a driving transistor DT and a first capacitor C1. The first capacitor C1 includes a first electrode plate 101 and a second electrode plate 102. The first electrode plate 101 is electrically connected to the first electrode (N2 node) of the driving transistor DT. The second electrode of the driving transistor DT is electrically connected to the first voltage terminal PVDD, and the driving transistor DT is for providing a light emitting current to the anode of the organic light emitting diode D1 under the control of the light emitting control module 14.

The initialization module 12 is electrically connected to the gate (N1 node) and the first electrode (N2 node) of the driving transistor DT, for writing signals from the first initialization signal terminal VIN and the second initialization signal terminal VREF respectively to the gate (N1 node) of the driving transistor DT and to the first electrode (N2 node) of the driving transistor DT, under the control of the first scanning signal terminal Scan1 and the second scanning signal terminal Scan2.

The data writing module 13 is electrically connected to the second electrode plate 102 of the first capacitor C1, to transmit a signal of the data signal terminal VDATA to the second electrode plate 102 of the first capacitor C1 under the control of the first scanning signal terminal Scan1.

The light emitting control module 14 includes a first transistor M1. Agate of the first transistor M1 is electrically connected to the light emitting signal terminal Emit. A first electrode of the first transistor M1 is electrically connected to the second electrode plate 102 of the first capacitor C1. A second electrode of the first transistor M1 is electrically connected to the gate (N1 node) of the driving transistor DT. A cathode of the organic light emitting diode D1 is electrically connected to the second voltage terminal PVEE.

In the pixel driving circuit 100, the initialization module 12 may first control the driving transistor DT to be turn on, and then control the potential of the gate (N1 node) of the driving transistor DT to be stabilized as A. Charging the first electrode (N2 node) of the driving transistor DT with the first voltage terminal PVDD, until the potential of the N2 node is pulled up to A−Vth, the driving transistor DT is turned off and the first voltage terminal PVDD stops charging, here, Vth is the threshold voltage of the driving transistor DT. And then the N1 node is controlled to be vacated so that the N2 node is charged to have its potential rises to Voled by the first voltage terminal PVDD. Utilizing the coupling of the first capacitor C1 to make the potential change of the N3 node to be Voled−(A−Vth), where Voled is the break-over voltage of the organic light emitting diode D1. Assuming that the data writing module 13 writes the potential B to the N3 node before the coupling of the first capacitor C1 occurs, the potential of the N3 node is B+Voled−(A−Vth). At this time, the first transistor M1 can be controlled to be turned on, thereby stabilizing the potential of the N1 node at the same potential B+Voled−(A−Vth) with the N3 node. The light emitting current of the organic light emitting diode D1 is positively correlated with Vgs−Vth, where Vgs is the potential difference between the gate (N1 node) of the driving transistor DT and the first electrode (N2 node) of the driving transistor DT, and the light emitting current is a value related to B+Voled−(A−Vth). As can be seen that the light emitting current is independent of the threshold voltage Vth of the driving transistor, i.e., the pixel driving circuit 100 realizes the compensation to the threshold voltage of the driving transistor and avoids the impact of the threshold drift on the display luminance.

While the first capacitor C1 is coupled to generate an electric charge, the N3 node is in a vacated state, so that the first capacitor C1 is coupled at the second electrode plate 102 and generates an electric charge, changing the potential of the N3 node and stabilizing the potential of the N2 node at Voled, i.e., the potential of the node of the organic light emitting diode D1 connected to the first capacitor is held stable by the first voltage terminal PVDD, so that the capacitance of the organic light emitting diode D1 does not divide the electric charge generated by coupling and the light emitting current of the organic light emitting diode D1 is not affected by its capacitance, and the display luminance of each organic light emitting diode does not change abnormally due to the impact of the capacitance value thereof, thereby ensuring the accuracy of the display luminance, balancing the uniformity of the display luminance and improving the display effect.

Figure 2:
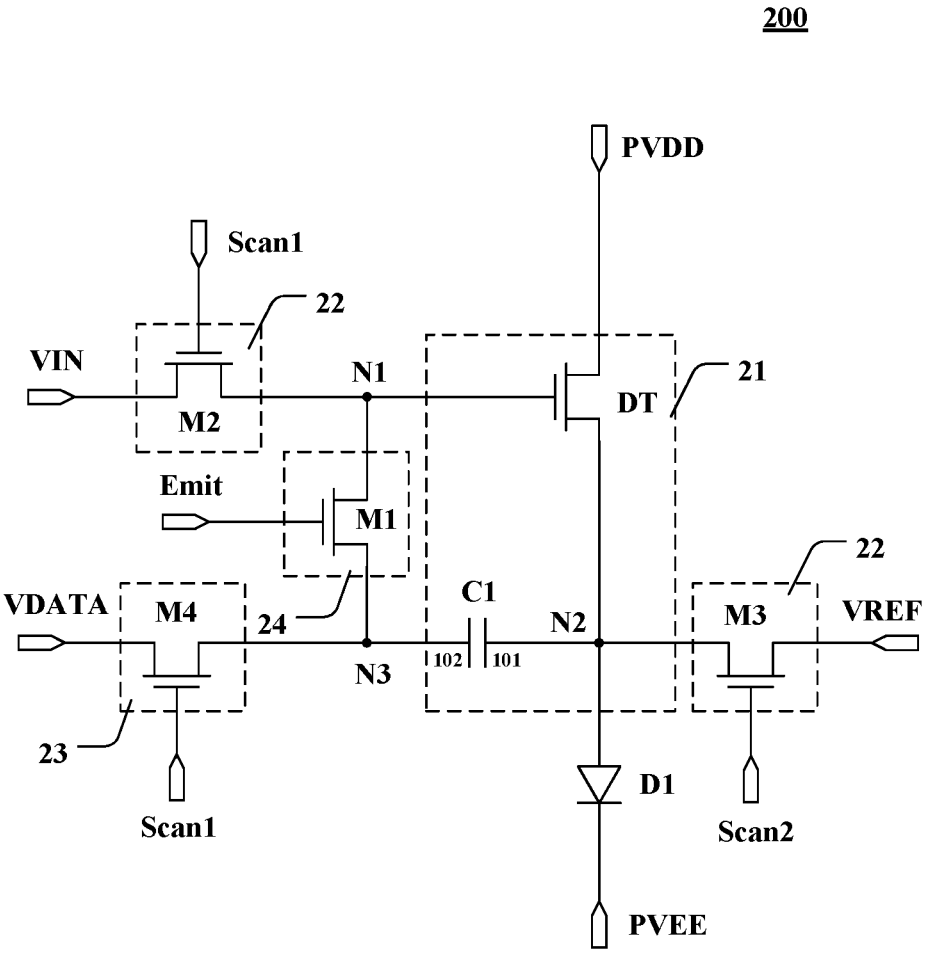
FIG. 2 is a schematic structural diagram of a specific circuit of the pixel driving circuit as shown in FIG. 1.

With reference to FIG. 2, a schematic structural diagram of a specific circuit of the pixel driving circuit as shown in FIG. 1 is illustrated.

As shown in FIG. 2, the pixel driving circuit 200 includes a driving module 21, an initialization module 22, a data writing module 23 and a light emitting control module 24. Here, the driving module 21 is identical to the driving module 11 in the pixel driving circuit 100 shown in FIG. 1. The driving module 21 includes a driving transistor DT and a first capacitor C1 including a first electrode plate 101 and a second electrode plate 102. A first electrode plate 101 is electrically connected to the first electrode (N2 node) of the driving transistor DT. The second electrode of the driving transistor DT is electrically connected to the first voltage terminal PVDD, and the driving transistor DT is for providing the light emitting current to the anode of the organic light emitting diode D1 under the control of the light emitting control module 24. The light emitting control module 24 is identical to the light emitting control module 14 in the pixel driving circuit 100 shown in FIG. 1, including a first transistor M1 in which the gate of the first transistor M1 is electrically connected to the light emitting signal terminal Emit, the first electrode of the first transistor M1 is electrically connected to the second electrode plate 102 (N3 node) of the first capacitor C1, and the second electrode of the first transistor M1 is electrically connected to the gate (N1 node) of the driving transistor DT.

In the present embodiment, the initialization module 22 includes a second transistor M2 and a third transistor M3. The second transistor M2 is for writing a signal of the first initialization signal terminal VIN to the gate (N1 node) of the driving transistor DT under the control of the first scanning signal terminal Scan1. Specifically, a gate of the second transistor M2 is electrically connected to the first scanning signal terminal Scan1. A first electrode of the second transistor M2 is electrically connected to the first initialization signal terminal VIN. A second electrode of the second transistor M2 is electrically connected to the gate (N1 node) of the driving transistor DT.

The third transistor M3 is for writing a signal of the second initialization signal terminal VREF to the first electrode (N2 node) of the driving transistor DT under the control of the second scanning signal terminal Scan2. Specifically, a gate of the third transistor M3 is electrically connected to the second scanning signal terminal Scan2. A first electrode of the third transistor M3 is electrically connected to the second initialization signal terminal VREF. A second electrode of the third transistor M3 is electrically connected to the first electrode (N2 node) of the driving transistor DT.

The data writing module 23 includes a fourth transistor M4 for transmitting a signal of the data signal terminal VDATA to the second electrode plate 102 of the first capacitor C1 under the control of the first scanning signal terminal Scan1. Specifically, a gate of the fourth transistor M4 is electrically connected to the first scanning signal terminal Scan1. A first electrode of the fourth transistor M4 is electrically connected to the data signal terminal VDATA. A second electrode of the fourth transistor M4 is electrically connected to the second electrode plate 102 of the first capacitor C1.

In the present embodiment, the first electrode (N2 node) of the driving transistor DT is electrically connected to the anode of the organic light emitting diode D1. The cathode of the organic light emitting diode D1 is electrically connected to the second voltage terminal PVEE, so that when a potential difference between the N2 node and the second voltage terminal PVEE is higher than a break-over voltage of the organic light emitting diode D1, the organic light emitting diode D1 emits light.

The pixel driving circuit 200 can compensate the threshold voltage of the driving transistor, and the problems of threshold drift impacting the display luminance and a poor display uniformity caused by different capacitances of different organic light emitting diodes can be avoided. The pixel driving circuit 200 has the following advantages: simple circuit structure, containing only one capacitor, each pixel driving circuit occupying a very small area, facilitating the design of a high-resolution display panel.

Figure 3:
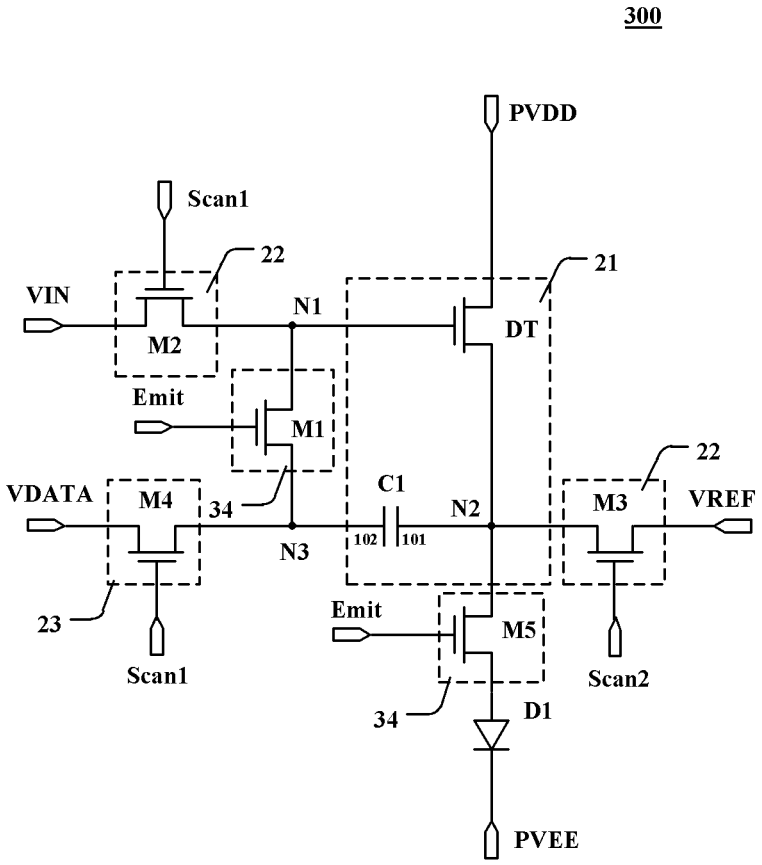
FIG. 3 is a schematic structural diagram of another specific circuit of the pixel driving circuit as shown in FIG. 1.

With further reference to FIG. 3, a schematic structural diagram of another specific circuit of the pixel driving circuit as shown in FIG. 1 is illustrated.

As shown in FIG. 3, the pixel driving circuit 300 includes a light emitting control module 34, and a driving module 21, an initialization module 22, a data writing module 23 which are identical to those in the pixel driving circuit 200 shown in FIG. 2. Here, the light emitting control module 34 includes the light emitting control module 24 shown in FIG. 2 and further includes a fifth transistor M5. The fifth transistor M5 is for transmitting a potential signal of the first electrode (N2 node) of the driving transistor DT to the anode of the organic light emitting diode D1 under the control of the light emitting signal terminal Emit. Specifically, a gate of the fifth transistor M5 is electrically connected to the light emitting signal terminal Emit. A first electrode of the fifth transistor M5 is electrically connected to the first electrode (N2 node) of the driving transistor DT. A second electrode of the fifth transistor M5 is electrically connected to the anode of the organic light emitting diode D1. The second electrode of the organic light emitting diode D1 is electrically connected to the second voltage terminal PVEE.

In the present embodiment, the anode of the organic light emitting diode D1 is not directly electrically connected to the first electrode (N2 node) of the driving transistor DT, but through the fifth transistor M5. The pixel driving circuits 200 and 300 first need to initialize the potentials of the gate (N1 node) and the first electrode (N2 node) of the driving transistor DT, acquire the threshold voltage Vth of the driving transistor DT, then write data signal to the driving transistor DT, and at last control the organic light emitting diode D1 to emit light according to the voltage difference between the gate and the first electrode of the driving transistor DT. Accordingly, for the pixel driving circuit 200 shown in FIG. 2, in the potential process of initializing the N1 node and the N2 node, the process of capturing the threshold voltage of the driving transistor DT, or the process of writing the data signal, if the voltage difference between the N2 node and the second voltage terminal PVEE is greater than the break-over voltage of the organic light emitting diode D1, the organic light emitting diode emits light, but then the emission luminance of the organic light emitting diode is not accurate, thus may causing a display error. And when the pixel driving circuit 300 is used, in the potential process of initializing the N1 node and the N2 node, the process of capturing the threshold voltage of the driving transistor DT, or the process of writing the data signal, the light emitting signal terminal Emit may be used to control the fifth transistor M5 to be turned off, to ensure that the signal of the N2 node can not be transmitted to the organic light emitting diode during the initialization, threshold voltage capturing, and the data signal writing processes, i.e., the organic light emitting diode D1 is not allowed to be turned on. After the data signal is written and the circuit operation state is stable, the fifth transistor M5 can be controlled to be turned on, and then the organic light emitting diode D1 may emit light according to the written data signal, thereby the display luminance of the organic light emitting diode D1 can be ensured to be accurate.

Figure 4:
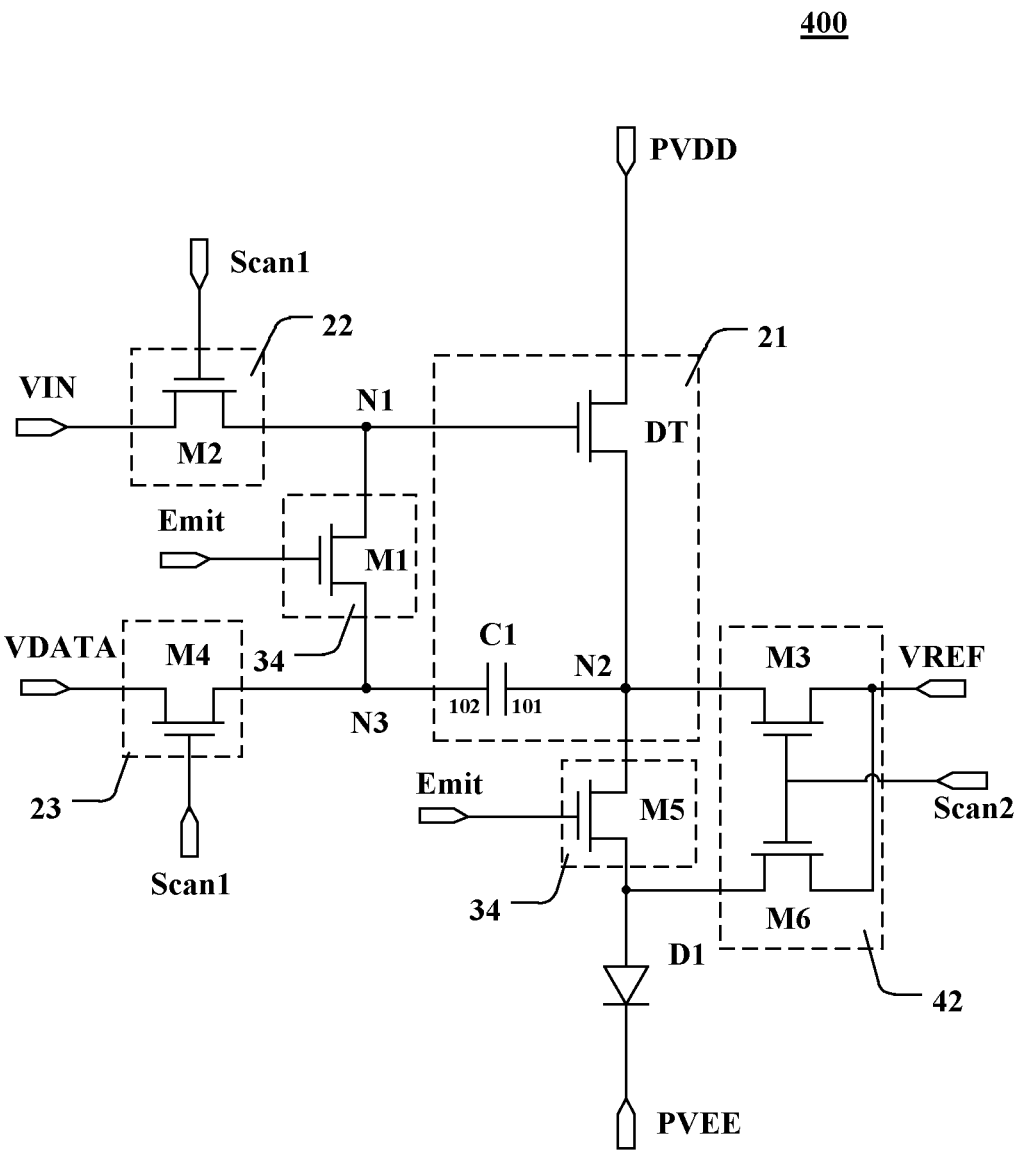
FIG. 4 is a schematic structural diagram of another specific circuit of the pixel driving circuit as shown in FIG. 1.

With further reference to FIG. 4, a schematic structural diagram of another specific circuit of the pixel driving circuit as shown in FIG. 1 is illustrated.

As shown in FIG. 4, the pixel driving circuit 400 includes an initialization module 42, and a driving module 21, a data writing module 23, a light emitting control module 34 which are identical to those in the pixel driving circuit 300 shown in FIG. 3. Here, the initialization module 42 includes an initialization module 22 of the pixel driving circuit 300 shown in FIG. 3 and further includes a sixth transistor M6. The sixth transistor M6 is for transmitting the signal of the second initialization signal terminal VREF to the anode (N4 node) of the organic light emitting diode D1 under the control of the second scanning signal terminal Scan2. Specifically, a gate of the sixth transistor M6 is electrically connected to the second scanning signal terminal Scan2. A first electrode of the sixth transistor M6 is electrically connected to the second initialization signal terminal VREF. The second electrode of the sixth transistor M6 is electrically connected to the anode (N4) of the organic light emitting diode D1.

Similar to the pixel driving circuit shown in FIG. 3, the pixel driving circuit 400 of the present embodiment has the advantages that the threshold voltage of the driving transistor can be compensated, the luminance of the organic light emitting diode is not related to its capacitance value, and the occupied area is small and the like. It is also possible to ensure that the organic light emitting diodes do not emit light at the phases of node potential initialization, threshold voltage capturing, data writing, etc. to ensure the accuracy of the display luminance. On the basis of the pixel driving circuit 300 shown in FIG. 3, the pixel driving circuit 400 of the present embodiment adds a sixth transistor M6 for resetting the anode of the organic light emitting diode D1. With the sixth transistor M6, the organic light emitting diode D1 may be quickly reset to a nonluminous state before displaying a frame, and the emission luminance of the organic light emitting diode in the previous frame can be prevented from affecting the state of the organic light emitting diode in the currently displayed frame, which further enhances the display accuracy.

The present disclosure provides an organic light emitting display panel including the above-described pixel driving circuits, the organic light emitting display panel including pixel driving circuits arranged in an array.

Figure 5:
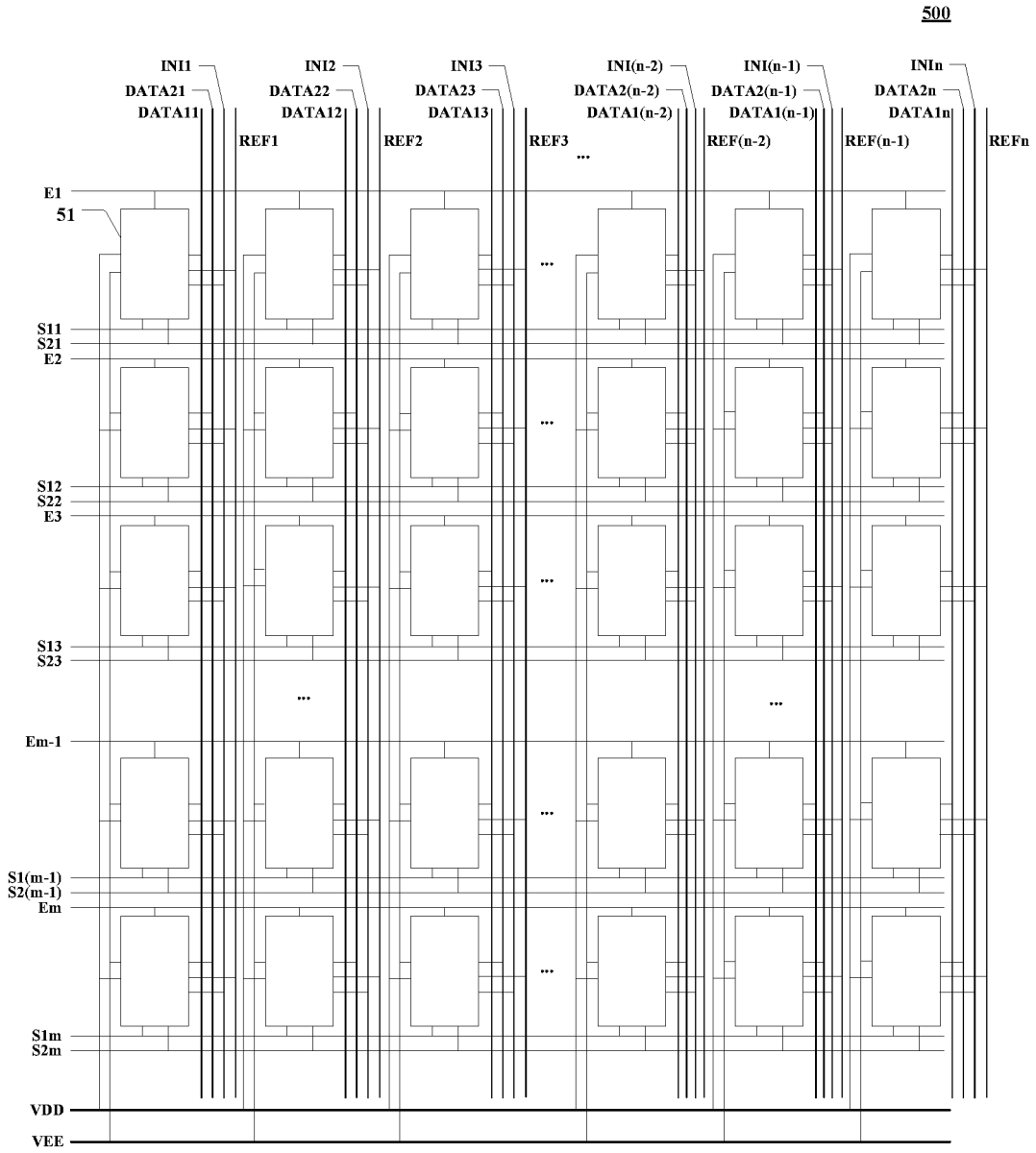
FIG. 5 is a schematic structural diagram of an embodiment of the organic light emitting display panel according to the present disclosure.

With reference to FIG. 5, a schematic structural diagram of an embodiment of the organic light emitting display panel according to the present disclosure is illustrated.

As shown in FIG. 5, the organic light emitting display panel 500 may include pixel driving circuits 51 arranged in an array. The pixel driving circuit 51 may be any one of the pixel driving circuits shown in the above FIGS. 1 to 4.

The organic light emitting display panel 500 further includes a plurality of first scanning signal lines S11, S12, S13, S1 (m−1), S1*m*, a plurality of second scanning signal lines S21, S22, S23, S2 (n−1), S2*m*, a plurality of light emitting signal lines E1, E2, E3, E (n−1), Em, a plurality of data signal lines DATA11, DATA21, DATA12, DATA22, DATA13, DATA23, . . . , DATA1 (n−2), DATA2 (n−2), DATA1 (n−2), DATA2 (n−2), DATA1*n*, DATA2*n*, at least one first initialization signal line INI1, INI2, INI3, . . . , INI (n−2), INI (n−1), INIn, at least one second initialization signal line REF1, REF2, REF3, . . . , REF (n−2), REF (n−1), REFn, a first voltage signal line VDD and a second voltage signal line VEE, here, m and n are positive integers.

The first scanning signal terminal Scan1 of each pixel driving circuit 51 is electrically connected to a first scanning signal line S11, S12, S13, S1 (m−1) or S1*m*. The second scanning signal terminal Scan2 of each pixel driving circuit 51 is electrically connected to a second scanning signal line S21, S22, S23, S2 (m−1) or S2*m*. The light emitting signal terminal Emit of each pixel driving circuit 51 is electrically connected to a light emitting signal line E1, E2, E3, E (m−1) or Em. The data signal terminal VDATA of each pixel driving circuit 51 is electrically connected to a data signal line DATA11, DATA21, DATA12, DATA22, DATA13, DATA1 DATA2 (n−2), DATA1 (n−1), DATA2 (n−1), DATA1*n* or DATA2*n*. The first initialization signal terminal VIN of each pixel driving circuit 51 is electrically connected to a first initialization signal line INI1, INI2, INI3, . . . , INI (n−2), INI (n−1) or INIn. The second initialization signal terminal VREF of each pixel driving circuit 51 is electrically connected to a second initialization signal line REF1, REF2, REF3, . . . , REF (n−2), REF(n−1) or REFn. The first voltage terminal PVDD of each pixel driving circuit 51 is electrically connected to a first voltage signal line VDD. The second voltage terminal PVEE of each pixel driving circuit 51 is electrically connected to a second voltage signal line VEE.

In the present embodiment, the data signal terminals in the plurality of pixel driving circuits 51 located in the same column are connected to two data signal lines, each of which is connected to a plurality of pixel driving circuits such as a plurality of pixel driving circuits 51 located in the first column are electrically connected to the data lines DATA11 and DATA21. Usually, luminance intensities of various sub-pixels are different, emission luminances of various organic light emitting diodes are different, and data signals received by the pixel driving circuits are different. When a plurality of pixel driving circuits are connected to one data signal line, the data signal line needs to transmit different data signals to the different pixel driving circuits in divided times, that is, during the time of displaying a frame picture, the driver IC (integrated circuit) needs to control the signal transmitted by each data signal line to change several times. The more the number of data signal lines, the less the number of pixel driving circuits that each data line needs to drive, so that the number of changes in the signal transmitted by each data signal line is reduced, and the rate of change of the signal transmitted from the driver IC to each data line is reduced, and the load of the driver IC can be reduced.

Further, as shown in FIG. 5, each of the first scanning signal lines S11, S12, S13, S1 (m−1) or S1*m* is respectively electrically connected to the first scanning signal terminal Scan1 of a row of pixel driving circuits 51. Each of the second scanning signal lines S21, S22, S23, S2 (m−1) or S2*m* is respectively electrically connected to the second scanning signal terminal Scan2 of a row of pixel driving circuits 51. Each of the light emitting signal lines E1, E2, E3, E (m−1) or Em is respectively electrically connected to the light emitting signal terminal Emit of a row of pixel driving circuits 51. Each of the first initialization signal lines INI1, INI2, INI3, . . . , INI (n−2), INI (n−1) or INIn is respectively electrically connected to the first initialization signal terminal VIN of a column of pixel driving circuits. Each of the second initialization signal lines REF1, REF2, REF3, . . . , REF (n−2), REF (n−1) or REFn is respectively electrically connected to the second initialization signal terminal VREF of a column of pixel driving circuits. The first voltage terminal PVDD of each pixel driving circuit 51 is electrically connected to the first voltage signal line VDD, and the second voltage terminal PVEE of each pixel driving circuit 51 is electrically connected to the second voltage signal line VEE. When displaying, the pixel driving circuits located on the same row are operated at the same time, so that the organic light emitting diodes in the pixel driving circuits located in the same row emit light simultaneously, and the organic light emitting diodes in the pixel driving circuit array may be lit line by line to complete the display of the entire screen.

Figure 6:
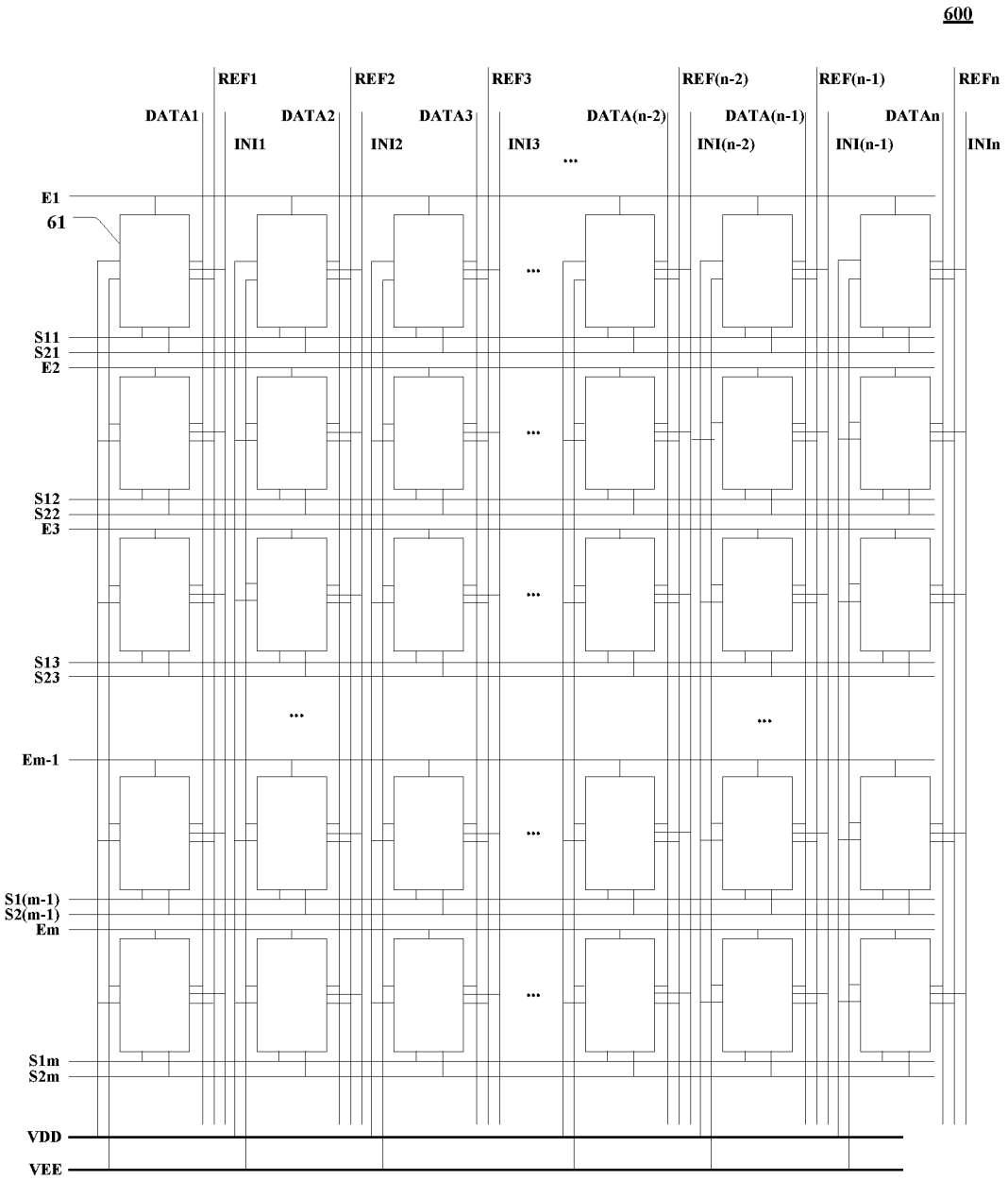
FIG. 6 is a schematic structural diagram of another embodiment of the organic light emitting display panel according to the present disclosure.

With reference to FIG. 6, a schematic structural diagram of another embodiment of the organic light emitting display panel according to the present disclosure is illustrated.

Unlike the embodiment shown in FIG. 5, the organic light emitting display panel 600 in the present embodiment includes a plurality of data signal lines DATA1, DATA2, DATA3, . . . , DATA (n−2), DATA (n−1) and DATAn. Here, n is a positive integer. Each data signal line is respectively electrically connected to the data signal terminal of a column of pixel driving circuits 61. In the present embodiment, the pixel driving circuits 61 located in the same column are connected to the same data signal line. Compared with the embodiment shown in FIG. 5, the organic light emitting display panel 600 shown in FIG. 6 reduces the number of data signal lines. Usually the data signal line can be directly connected to the port of the driver IC or connected to the port of the driver IC through the time-sharing circuit, and the number of ports of the driver IC required and occupied by the data signal line is positively correlated with the number of the data signal lines. Therefore, the organic light emitting display panel of the present embodiment can reduce the number of the ports of the driver IC occupied and simplify the port design of the IC.

Figure 7:
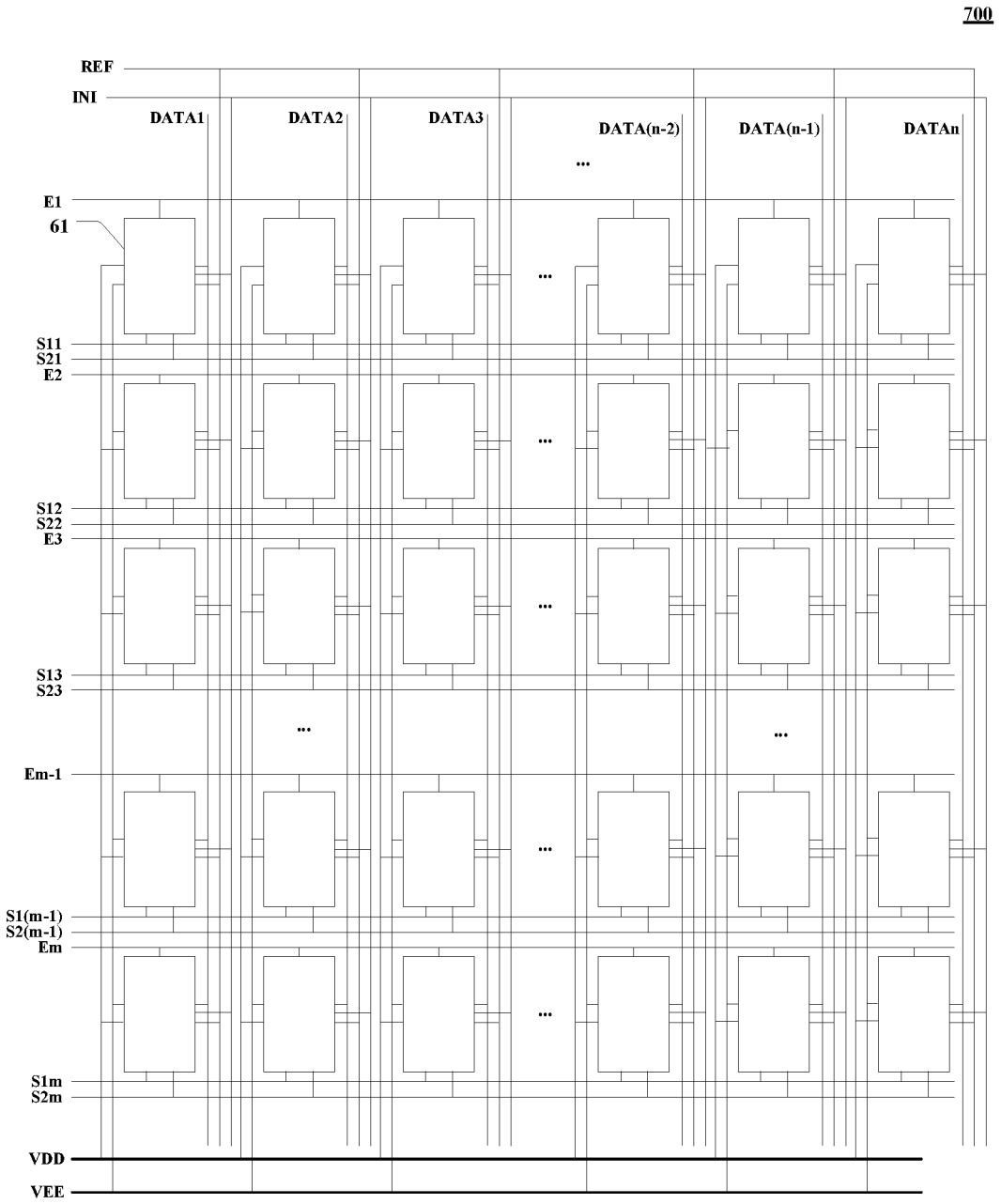
FIG. 7 is a schematic structural diagram of another embodiment of the organic light emitting display panel according to the present disclosure.

With further reference to FIG. 7, a schematic structural diagram of another embodiment of the organic light emitting display panel according to the present disclosure is illustrated.

On the basis of the organic light emitting display panel 600 shown in FIG. 6, the first initialization signal terminal VIN of each pixel driving circuit 71 in the organic light emitting display panel 700 provided in the present embodiment is electrically connected to the same first initialization signal line INI. The second initialization signal terminal VREF of each pixel driving circuit 71 is electrically connected to the same second initialization signal line REF. That is, each pixel driving circuit 71 receives the first initialization signal through the same first initialization signal line INI, and each pixel driving circuit 71 receives the second initialization signal through the same second initialization signal line REF, thereby further reducing the number of signal lines connected to the driver IC and reducing the number of ports occupied by the driver IC.

FIGS. 5, 6, and 7 only schematically show the connection relationship between signal lines and the pixel driving circuits in the organic light emitting display panel of the present disclosure. In other embodiments of the present disclosure, the plurality of pixel driving circuits connected to each data signal line may be located in different columns. The plurality of pixel driving circuits connected to each first scanning signal line may be located in different rows. The pixel driving circuits connected to each second scanning signal line may be located in different rows. The plurality of pixel driving circuits connected to each light emitting signal line may be located in different rows. The number of the first voltage signal lines and the second voltage signal lines may be plural.

It should be noted that the first transistor M1, the second transistor M2, the third transistor M3, the fourth transistor M4, the fifth transistor M5, and the driving transistor DT in the above embodiments may each be a N-type transistor or a P-type transistor. When the driving transistor DT is a N-type transistor, its threshold voltage Vth>0. When the driving transistor is a P-type transistor, its threshold voltage Vth<0.

The present disclosure also provides a driving method applied to each of the embodiments of the above organic light emitting display panel. In the driving method, the operation process of each pixel driving circuit includes three phases.

Specifically, in the first phase, a first level signal is provided to the first scanning signal terminal Scan1 and the second scanning signal terminal Scan2, a second level signal is provided to the light emitting signal terminal Emit, a first initialization signal Vin is provided to the first initialization signal terminal VIN, a second initialization signal VRef1 is provided to the second initialization signal terminal VREF, and a data signal Vdata is provided to the data signal terminal. The initialization module writes the first initialization signal Vin and the second initialization signal VRef1 respectively to the gate (N1 node) of the driving transistor DT and the first electrode (N2 node) of the driving transistor DT, and the data writing module transmits the data signal Vdata to the second electrode plate 102 of the first capacitor C1.

In the second phase, the first level signal is provided to the first scanning signal terminal Scan1, the second level signal is provided to the second scanning signal terminal Scan2 and the light emitting signal terminal Emit, the first initialization signal Vin is provided to the first initialization signal terminal VIN, and the data signal Vdata is provided to the data signal terminal VDATA. The initialization module writes the first initialization signal Vin to the gate (N1 node) of the driving transistor DT. The data writing module transmits the data signal Vdata to the second electrode plate 102 of the first capacitor C1. The driving transistor DT is turned on. The first electrode plate 101 of the first capacitor C1 is charged by the first voltage terminal PVDD.

In the third phase, the second level signal is provided to the first scanning signal terminal Scan1 and the second scanning signal terminal Scan2, and the first level signal is provided to the light emitting signal terminal Emit. The driving transistor DT and the first transistor M1 are turned on. The first electrode (N2 node) of the driving transistor DT is charged by the first voltage terminal PVDD. The light emitting control module turns on the second electrode plate 102 (N3 node) of the first capacitor C1 and the gate (N1 node) of the driving transistor DT. The potential of the gate (N1 node) of the driving transistor DT rises under the coupling of the first capacitor C1. The organic light emitting diode D1 emits light under the voltage difference between the gate (N1 node) and the first electrode (N2 node) of the driving transistor DT.

Here, the voltage value of the first initialization signal Vin is greater than the sum of the voltage value of the second initialization signal VRef1 and the threshold voltage of the driving transistor DT.

The operation principle of each pixel driving circuit driven by the driving method will be further illustrated with reference to FIG. 8 in the following example, in which the first transistor M1, the second transistor M2, the third transistor M3, the fourth transistor M4, the fifth transistor M5, the sixth transistor M6 and the driving transistor DT in the above embodiments are all N-type transistors, the first level signal in the driving method is a high level signal, and the second level signal is a low level signal. Here, SC1, SC2, EM, Data, IN and Vref denote to signals provided respectively to the first scanning signal terminal Scan1, the second scanning signal terminal Scan2, the light emitting signal terminal Emit, the data signal terminal VDATA, the first initialization signal terminal VIN and the second initialization signal terminal VREF. Here, the high level and the low level represent only the relative relationship between the levels, and are not particularly limited to a certain level signal. The high level signal may be a signal for turning on the first to the sixth transistors, and the low level signal may be a signal for turning off the first to the sixth transistors.

Figure 8:
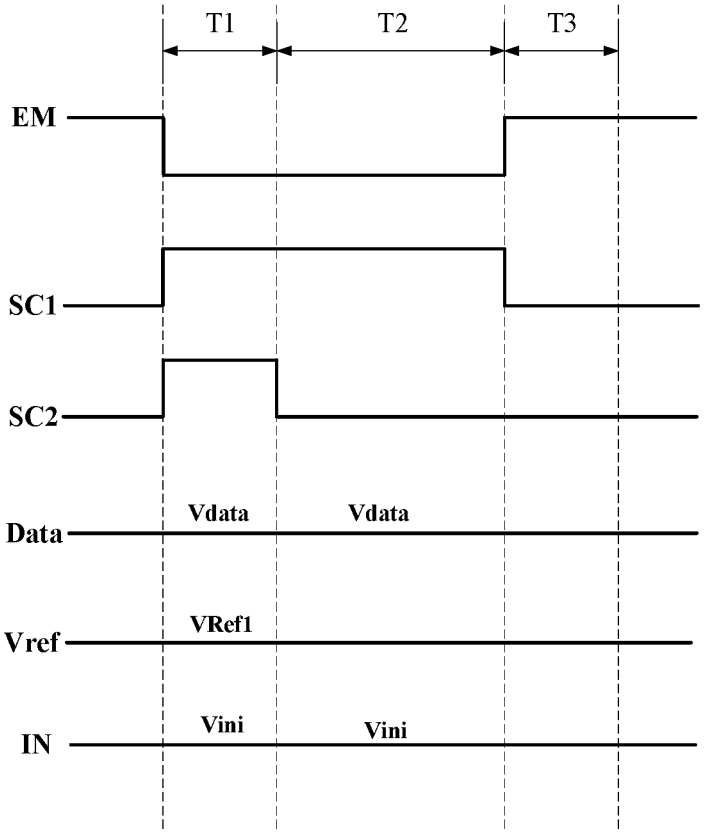
FIG. 8 is a schematic diagram of the operation timing sequence of the pixel driving circuit as shown in FIG. 2, 3 or 4.

With reference to FIG. 8, a schematic diagram of the operation timing sequence of the pixel driving circuits as shown in FIGS. 2, 3 and 4 is illustrated.

For the pixel driving circuit 200 shown in FIG. 2, in the first phase T1, a first level signal is provided to the first scanning signal terminal Scan1 and the second scanning signal terminal Scan2. A second level signal is provided to the light emitting signal terminal Emit. The first initialization signal Vin is provided to the first initialization signal terminal VIN. The second initialization signal VRef1 is provided to the second initialization signal terminal VREF. The data signal Vdata is provided to the data signal terminal. The second transistor M2 is turned on, and the first initialization signal Vin is written to the gate (N1 node) of the driving transistor DT. The third transistor M3 is turned on, and the second initialization signal VRef1 is written to the first electrode (N2 node) of the driving transistor DT. The fourth transistor M4 is turned on, and the data signal Vdata is transmitted to the second electrode plate 102 of the first capacitor C1. Here, the voltage value of the first initialization signal Vin is greater than the sum of the voltage value of the second initialization signal VRef1 and the threshold voltage Vth of the driving transistor DT, and the voltage difference between the second initialization signal VRef1 and the second voltage terminal PVEE (the voltage value is VPVEE) is less than the break-over voltage Voled of the organic light emitting diode D1. That is, Vin−VRef1>Vth and VRef1−VPVEE<Voled, and the voltage difference between the gate and the first electrode of the driving transistor DT is greater than its threshold voltage, so that the driving transistor DT is turned on before entering the next phase. In addition, the voltage difference between the anode and the cathode of the organic light emitting diode D1 is less than its break-over voltage thereof, ensuring that the organic light emitting diode D1 is prevented from being lit at this phase.

In the second phase T2, the first level signal is provided to the first scanning signal terminal Scan1. The second level signal is provided to the second scanning signal terminal Scan2 and the light emitting signal terminal Emit. The first initialization signal Vin is provided to the first initialization signal terminal VIN. The data signal Vdata is provided to the data signal terminal VDATA. At this time, the third transistor M3 is turned off and the second transistor M2 is turned on, so that the potential of the gate (N1 node) of the driving transistor DT is maintained as the first initialization signal Vin, and the potential of the N1 node VN1=Vin. The fourth transistor M4 is turned on, so that the potential of the second electrode plate 102 (N3 node) of the first capacitor C1 is maintained as the data signal Vdata, and the potential of the N3 node VN3=Vdata. The driving transistor DT is turned on and the second electrode (or the first electrode plate 101 of the first capacitor C1, the N2 node) of the driving transistor DT is charged by the first voltage terminal PVDD. When the potential of the N2 node rises to Vin−Vth, the voltage difference between the gate and the first electrode of the driving transistor DT is equal to Vth, the driving transistor is turned off, and the first voltage terminal PVDD stops charging the N2 node. At this phase, the potential VN2 of the N2 node is stabilized at VN2=Vin−Vth, here Vth is the threshold voltage of the driving transistor DT. Here, the N2 node is electrically connected to the anode of the organic light emitting diode D1 and needs to meet the following requirements: the voltage difference between the first initialization signal Vin and the second voltage terminal PVEE is less than the sum of the threshold voltage Vth of the driving transistor DT and the break-over voltage Voled of the organic light emitting diode D1, that is, Vin VPVEE<Vth+Voled, or Vin−Vth−VPVEE<Voled, so that the voltage difference between the anode and the cathode of the organic light emitting diode D1 is less than its break-over voltage to ensure that the organic light emitting diode does not emit light at the second phase T2.

In the third phase T3, the second level signal is provided to the first scanning signal terminal Scan1 and the second scanning signal terminal Scan2, and the first level signal is provided to the light emitting signal terminal Emit. When the gate (N1 node) of the driving transistor DT is in a vacated state and the potential thereof is unstable, the first electrode (N2 node) of the driving transistor DT may continue charged by the first voltage terminal PVDD, and when the potential of the N2 node rises to the break-over voltage Voled of the organic light emitting diode D1, the organic light emitting diode D1 emits light, and the potential of the N2 node stops rising, at this point VN2=Voled. The second electrode plate 102 (N3 node) of the first capacitor C1 is in a vacated state at the third phase T3, so that the potential of the N3 node also changes under the coupling of the first capacitor C1, and the change is consistent with the potential change of the N2 node, both of which are Voled−(Vin−Vth). Then the potential of the N3 node VN3=Vdata+Voled−(Vin−Vth), and the first transistor M1 is turned on, so that the potential of the N1 node VN1=VN3=Vdata+Voled−(Vin−Vth).

In the third phase T3, the organic light emitting diode D1 emits light according to the voltage difference Vgs between the gate (N1 node) of the driving transistor DT and the first electrode (N2 node) of the driving transistor DT. At this time, the source of the driving transistor DT is the N2 node, and the gate source potential difference of the driving transistor DT is Vgs=VN1−VN2=Vdata+Voled−(Vin−Vth)−Voeld=Vdata−Vin+Vth, and the light emitting current Ids of the organic light emitting diode D1 can be calculated using the following equation $$\begin{aligned} Ids &= K\square(Vgs - |Vth|)^2 \qquad (1) \\ &= K\square(Vdata - Vin + Vth - Vth)^2 \\ &= K\square(Vdata - Vin)^2 \end{aligned}$$

Here, K is the ratio of the width and the length of the channel of the driving transistor DT and a related coefficient of capacitance per unit area of the driving transistor DT. As can be observed from the equation (1), the light emitting current Ids of the organic light emitting device D1 is independent of the threshold voltage Vth of the driving transistor DT, the capacitance value of the first capacitor C1 and the capacitance value of the organic light emitting diode D1, thereby the pixel driving circuit 200 shown in FIG. 2 realizes the compensation to the threshold voltage of the driving transistor. In addition, different organic light emitting diodes have the same light emitting current under the driving of the same data signal Vdata, so as to have the same emission luminance, resulting improvements of the luminance uniformity of the display and the display effect.

The pixel driving circuit 300 shown in FIG. 3 differs from the operation principle of the pixel driving circuit 200 shown in FIG. 2 described above in that: the N2 node is connected to the anode of the organic light emitting diode D1 through the fifth transistor M5, so that in the first phase T1 and the second phase T2, the fifth transistor M5 is turned off, the N2 node is disconnected from the organic light emitting diode D1, and the potential of the N2 node does not affect the state of the organic light emitting diode. Therefore, for the pixel driving circuit shown in FIG. 3, it is only required that the voltage value of the first initialization signal Vin is greater than the sum of the voltage value of the second initialization signal VRef1 and the threshold voltage Vth of the driving transistor DT (i.e., Vin−VRef1>Vth), which ensures that in the first phase T1 the driving transistor DT is turned on. It is not necessary to satisfy that the voltage difference between the second initialization signal VRef1 and the second voltage terminal PVEE (voltage value is VPVEE) is less than the break-over voltage Voled of the organic light emitting diode D1 (i.e., VRef1−VPVEE<Voled), and that the voltage difference between the first initialization signal Vin and the second voltage terminal PVEE is less than the sum of the threshold voltage Vth of the driving transistor DT and the break-over voltage Voled of the organic light emitting diode D1 (i.e., Vin−Vth−VPVEE<Voled). Thus, the limitation to the first initialization signal Vin and the second initialization signal VRef1 is reduced, so that the driver IC may set an appropriate first initialization signal value and second initialization signal value within an optional range, and the load of the driver IC can be reduced.

The pixel driving circuit 400 shown in FIG. 4 differs from the operation principle of the above described pixel driving circuit 200 shown in FIG. 2 in that: in the first phase T1, the fifth transistor M5 is turned off, the sixth transistor M6 is turned on, and the second initialization signal VRef1 is transmitted to the anode (N4 node) of the organic light emitting diode D1. Similar to the pixel driving circuit 200 shown in FIG. 2, the pixel driving circuit 400 also need to meet the following conditions: the voltage value of the first initialization signal Vin is greater than the sum of the voltage value of the second initialization signal VRef1 and the threshold voltage Vth of the driving transistor DT (i.e., Vin−VRef1>Vth). In addition, since the potential of the anode of the organic light emitting diode D1 is also initialized to VRef1, it is also required that the voltage difference between the second initialization signal VRef1 and the second voltage terminal PVEE (voltage value is VPVEE) is less than the break-over voltage Voled of the organic light emitting diode D1 (i.e., VRef1−VPVEE<Voled), to ensure that the organic light emitting diode D1 does not emit light in the first phase T1. In the second phase T2, the fifth transistor M5 and the sixth transistor M6 in the pixel driving circuit 300 are turned off, so that the potential of the N2 node does not affect whether the organic light emitting diode D1 is turned on, and for the pixel driving circuit 400 shown in FIG. 4, it is not necessary to satisfy that the voltage difference between the first initialization signal Vin and the second voltage PVEE is less than the sum of the threshold voltage Vth of the driving transistor DT and the break-over voltage Voled of the organic light emitting diode D1 (i.e., Vin−Vth−VPVEE<Voled), it can be ensured that the organic light emitting diode D1 does not emit light in the second phase T2.

For the pixel driving circuit 300 shown in FIG. 3 and the pixel driving circuit 400 shown in FIG. 4, the driving method further includes: in the third phase T3, the fifth transistor M5 is turned on so that the light emitting current provided by the driving transistor DT is transmitted to the organic light emitting Diode D1. Similarly, the light emitting current of the organic light emitting diode D1 is only related to the data signal Vdata and the first initialization signal Vin, and is independent of the threshold voltage Vth of the driving transistor DT and the capacitance of the organic light emitting diode D1, so that the pixel driving circuits can be kept in a stable and reliable working status, which helps to enhance the display effect. In addition, as can be seen from FIG. 8, each of the pixel driving circuits described above has a relatively simple the operation timing sequence, which helps to reduce the load of the driver IC.

Alternatively, the driving method further comprises: providing the first voltage signal to the first voltage terminal PVDD and providing the second voltage signal to the second voltage terminal PVEE in the first phase T1, the second phase T2 and the third phase T3. The voltage value of the first voltage signal is higher than the voltage value of the second voltage signal.

Figure 9:
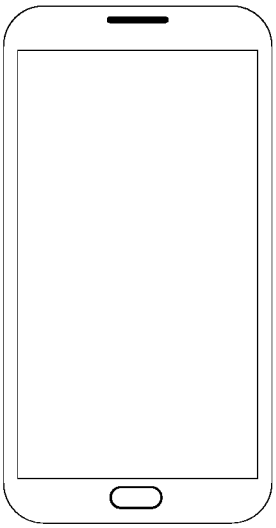
FIG. 9 is a schematic diagram of an organic light emitting display apparatus provided by the present disclosure.

In addition, the present disclosure also provides an organic light emitting display apparatus, as shown in FIG. 9, the organic light emitting display apparatus 900 includes the organic light emitting display panel of each of the embodiments described above, and may be a mobile phone, a tablet computer, a wearable device, or the like. It is understandable that the organic light emitting display apparatus 900 may include a known structure such as a package film and a protective glass, therefore detailed descriptions will be omitted.

The foregoing is only a description of the preferred embodiments of the present disclosure and the applied technical principles. It should be appreciated by those skilled in the art that the inventive scope of the present disclosure is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present disclosure with (but not limited to), technical features with similar functions.

What is claimed is:

1. An organic light emitting display panel, comprising:

a plurality of pixel driving circuits arranged in a matrix of a plurality of rows and a plurality of columns, where the pixel driving circuit comprises a first scanning signal terminal, a second scanning signal terminal, a light emitting signal terminal, a data signal terminal, a first initialization signal terminal, a second initialization signal terminal, a first voltage terminal, a second voltage terminal, a driving module, an initialization module, a data writing module, a light emitting control module and an organic light emitting diode;

wherein the driving module comprises:

a driving transistor and a first capacitor, wherein the first capacitor includes a first electrode plate and a second electrode plate, wherein the first electrode plate electrically connects to a first electrode of the driving transistor, wherein a second electrode of the driving transistor electrically connects to the first voltage terminal;

wherein the driving transistor provides a light emitting current to an anode of the organic light emitting diode under the control of the light emitting control module;

wherein the initialization module electrically connects to a gate of the driving transistor and the first electrode of the driving transistor, for writing signals from the first initialization signal terminal and the second initialization signal terminal respectively to both the gate of the driving transistor and the first electrode of the driving transistor, under the control of the first scanning signal terminal and the second scanning signal terminal;

wherein the data writing module electrically connects to the second electrode plate of the first capacitor, for transmitting a signal of the data signal terminal to the second electrode plate of the first capacitor, under the control of the first scanning signal terminal;

wherein the light emitting control module comprises a first transistor, wherein a gate of the first transistor electrically connects to the light emitting signal terminal, a first electrode of the first transistor electrically connects to the second electrode plate of the first capacitor, and a second electrode of the first transistor electrically connects to the gate of the driving transistor;

wherein a cathode of the organic light emitting diode electrically connects to the second voltage terminal; and wherein in a first phase, a first level signal is provided to the first scanning signal terminal and the second scanning signal terminal;

a second level signal is provided to the light emitting signal terminal;

a first initialization signal is provided to the first initialization signal terminal;

a second initialization signal is provided to the second initialization signal terminal;

a data signal is provided to the data signal terminal;

wherein the initialization module writes the first initialization signal and the second initialization signal respectively into the gate and the first electrode of the driving transistor, and the data writing module transmits the data signal to the second electrode plate of the first capacitor;

in a second phase, wherein:

the first level signal is provided to the first scanning signal terminal;

the second level signal is provided to the second scanning signal terminal and the light emitting signal terminal;

the first initialization signal is provided to the first initialization signal terminal;

the data signal is provided to the data signal terminal;

the initialization module writes the first initialization signal into the gate of the driving transistor, and the data writing module transmit the data signal to the second electrode plate of the first capacitor;

the driving transistor is turned on;

the first voltage terminal charges the first electrode plate of the first capacitor; and in a third phase, wherein:

the second level signal is provided to the first scanning signal terminal and the second scanning signal terminal;

the first level signal is provided to the light emitting signal terminal;

the driving transistor and the first transistor are turned on;

the first voltage terminal charges the first electrode of the driving transistor;

the light emitting control module turns on the second electrode plate of the first capacitor and the gate of the driving transistor, and a potential of the gate of the driving transistor rises under the coupling of the first capacitor; and the organic light emitting diode emits light under a voltage difference between the gate and the first electrode of the driving transistor;

and wherein a voltage value of the first initialization signal is greater than a sum of a voltage value of the second initialization signal and a threshold voltage of the driving transistor.

2. The organic light emitting display panel according to claim 1, wherein the initialization module comprises a second transistor and a third transistor;

wherein a gate of the second transistor is electrically connected to the first scanning signal terminal, a first electrode of the second transistor is electrically connected to the first initialization signal terminal, and a second electrode of the second transistor is electrically connected to the gate of the driving transistor; and wherein a gate of the third transistor is electrically connected to the second scanning signal terminal, a first electrode of the third transistor is electrically connected to the second initialization signal terminal, and a second electrode of the third transistor is electrically connected to the first electrode of the driving transistor.

3. The organic light emitting display panel according to claim 1, wherein the data writing module comprises a fourth transistor, a gate of the fourth transistor is electrically connected to the first scanning signal terminal, a first electrode of the fourth transistor is electrically connected to the data signal terminal, and a second electrode of the fourth transistor is electrically connected to the second electrode plate of the first capacitor.

4. The organic light emitting display panel according to claim 1, wherein the first electrode of the driving transistor is electrically connected to the anode of the organic light emitting diode.

5. The organic light emitting display panel according to claim 1, wherein the light emitting control module further comprises a fifth transistor; and wherein a gate of the fifth transistor is electrically connected to the light emitting signal terminal, a first electrode of the fifth transistor is electrically connected to the first electrode of the driving transistor, and a second electrode of the fifth transistor is electrically connected to the anode of the organic light emitting diode.

6. The organic light emitting display panel according to claim 1, wherein the initialization module further comprises a sixth transistor; and wherein a gate of the sixth transistor is electrically connected to the second scanning signal terminal, a first electrode of the sixth transistor is electrically connected to the second initialization signal terminal, and a second electrode of the sixth transistor is electrically connected to the anode of the organic light emitting diode.

7. The organic light emitting display panel according to claim 1, wherein a voltage difference between the first initialization signal and the second voltage terminal is less than a sum of the threshold voltage of the driving transistor and a break-over voltage of the organic light emitting diode; and wherein a voltage difference between the second initialization signal and the second voltage terminal is less than the break-over voltage of the organic light emitting diode.

8. The organic light emitting display panel according to claim 1, the first phase further comprises:

transmitting the second initialization signal to the anode of the organic light emitting diode by the initialization module, and wherein the voltage difference between the second initialization signal and the second voltage terminal is less than the break-over voltage of the organic light emitting diode.

9. The organic light emitting display panel according to claim 1, the driving method further comprises:

in the first phase, the second phase and the third phase, providing a first voltage signal to the first voltage terminal and providing a second voltage signal to the second voltage terminal; and a voltage value of the first voltage signal is higher than a voltage value of the second voltage signal.

10. An organic light emitting display apparatus comprising the organic light emitting display panel according to claim 1.

* * * * *